US007684748B2

(12) United States Patent
Masuda et al.

(10) Patent No.: US 7,684,748 B2
(45) Date of Patent: Mar. 23, 2010

(54) UNIT DRAWING MECHANISM AND IMAGE RECORDING APPARATUS

(75) Inventors: Junya Masuda, Ikoma (JP); Kohichi Matsumoto, Gojo (JP); Toyokazu Mori, Soraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 621 days.

(21) Appl. No.: 11/581,780

(22) Filed: Oct. 17, 2006

(65) Prior Publication Data

US 2007/0092321 A1 Apr. 26, 2007

(30) Foreign Application Priority Data

Oct. 18, 2005 (JP) ..... 2005-303045
Nov. 7, 2005 (JP) ..... 2005-322542

(51) Int. Cl.
*G03G 15/00* (2006.01)

(52) U.S. Cl. ..... 399/388; 399/381

(58) Field of Classification Search ..... 399/388, 399/381; 312/298
See application file for complete search history.

(56) References Cited

U.S. PATENT DOCUMENTS 6,079,707 A * 6/2000 Fujiwara et al. ..... 271/207
6,086,176 A * 7/2000 Aoyama ..... 312/286

FOREIGN PATENT DOCUMENTS

| | | | |
|---|---|---|---|
| JP | 62-6269 | | 1/1987 |
| JP | 01181647 | A * | 7/1989 |
| JP | 9-134050 | | 5/1997 |
| JP | 2002/356245 | | 12/2002 |

* cited by examiner

*Primary Examiner*—Judy Nguyen
*Assistant Examiner*—Allister Primo
(74) *Attorney, Agent, or Firm*—Nixon & Vanderhye P.C.

(57) ABSTRACT

A unit drawing mechanism according to the invention is adapted for installation in a main unit. The mechanism includes a first and a second units, a plurality of supports, and a load-applying member. The first unit is movable along a first direction toward front of the main unit, to be drawn out thereof. Mounted in the first unit, the second unit is movable, with the first unit drawn out of the main unit, along a second direction perpendicular to the first direction, to be drawn out of the first unit. The supports are arranged at different positions along the second direction, for supporting the first unit movably along the first direction. The load-applying member is mounted in the first unit in such a manner that center of gravity of the first unit along the second direction is located between the supports whether the second unit is retracted in, or drawn out of, the drawn-out first unit.

16 Claims, 14 Drawing Sheets

UNIT DRAWING MECHANISM AND IMAGE RECORDING APPARATUS

CROSS REFERENCE

This Nonprovisional application claims priority under 35 U.S.C. §119(a) on Patent Applications No. 2005-303045 and No. 2005-322542 filed in Japan on Oct. 18 and Nov. 7, 2005, respectively, the entire contents of which are hereby incorporated by reference.

BACKGROUND

The disclosed technology relates to a unit drawing mechanism for drawing a unit out from a main unit, and to an image recording apparatus for recording an image on a sheet being transported on a sheet transport path.

In electrophotographic image recording apparatus, a sheet is fed from a sheet feeding tray to an image recording section where an image is formed on the sheet. Then the sheet is output to a sheet output tray. A sheet may become jammed on its way on a sheet transport path. A sheet jam is likely to occur particularly in the image recording section. This is because a sheet tends to be curled while undergoing various processes in the image recording section such as: a developer-image transfer process performed by a transfer device; or a fusing process performed by a fusing device.

A sheet jam is also likely to occur in a reversing transport path on which, in duplex image formation (an image is formed on both sides of a sheet), a sheet with an image formed on a first side is reversed and transported back to the image recording section. This is because the duplex image formation involves a sheet passing through many bifurcations of the sheet transport path.

In the event of a sheet jam, image recording apparatus suspend an image forming process until all sheets present on the sheet transport path are removed. JP H09-134050A discloses that a sheet jammed in the image recording section is removed by drawing the image recording section in a forward direction out of the image recording apparatus and opening a side wall or the like of the section to expose the sheet transport path.

The foregoing configuration of the prior art apparatus, however, involves a small level of exposure of a portion of the sheet transport path located in the image recoding section, even with the image recording section drawn out and the side wall opened. Thus, this configuration renders it hard for a user to remove a jammed sheet. In particular, recent image recording apparatus with high functionality have a complex configuration that renders it hard to provide a large space for removing a jammed sheet.

In consecutive image formation that involves a plurality of sheets present on the sheet transport path, a user is necessitated, if only a small level of exposure of sheet transport path is available, to open side walls or the like of different portions of the image recording section in order to check if all the sheets are removed from the sheet transport path.

As a solution to the foregoing problem, a unit drawing mechanism adapted for use in an image recording apparatus has been proposed that includes a first unit and a second unit. The first unit, in which a first path as part of a sheet transport path is positioned, is movable along a forward direction to draw the first unit out of the apparatus. With the first unit drawn out of the apparatus, the second unit is movable along a direction, perpendicular to the forward direction, to draw the second unit out of the first unit. In the second unit, a second path as another part of the sheet transport path is positioned.

The proposed mechanism eliminates the need for provision of a dedicated space for drawing the unit 2 out of the unit 1 along the forward direction, since space for a user to remove a printed sheet also serves as the space for drawing the unit 2 out of the unit 1. Also, the proposed mechanism allows the second unit to be detached from the first unit by being drawn out of the first unit, thereby enabling the first and second paths to have a greater exposed area than in a conventional configuration where the first and second units are integrated in a single unit. Additionally, the second unit is slidably supported by a slide rail assembly.

For improved workability, it is preferable that the unit drawing mechanism has a minimum number of support members for supporting the first unit so that the first unit is movable. In the proposed mechanism, however, detachment of the second unit from the first unit involves a major shift in the center of gravity of the first unit. Therefore, repeated detachment and attachment of the second unit from and to the first unit causes deformation in the supports of the first unit, resulting in a decrease in positioning accuracy of the first and second units with respect to the apparatus. In order to ensure strength, further, it is necessary to provide a sufficient number of supports for the first unit.

Furthermore, the proposed mechanism is not provided with means for securing the second unit to the first unit so that the second unit does not move. This results in a decreased positioning accuracy of the second unit with respect to the first unit. This also may cause undesirable movement of the second unit drawn out of the first unit.

In light of the foregoing, a non-limiting feature of the disclosed technology provides a unit drawing mechanism with a simple configuration that maintains a high level of positioning accuracy of a first and a second units with respect to an apparatus provided therewith, that ensures a high level of positioning accuracy of the second unit with respect to the first unit by securing the second unit to the first unit so that the second unit does not move, and that prevents undesirable movement of the second unit drawn out of the first unit.

SUMMARY

A unit drawing mechanism according to a non-limiting embodiment is adapted for installation in a main unit. The mechanism includes a first unit, a second unit, a plurality of supports, and a load-applying member. The first unit is movable along a first direction toward front of the main unit, to be drawn out of the main unit. The second unit is mounted in the first unit. The second unit is movable, with the first unit drawn out of the main unit, along a second direction that is substantially perpendicular to the first direction, to be drawn out of the first unit. The supports are arranged at different positions along the second direction, for supporting the first unit movably along the first direction.

The load-applying member is mounted in the first unit in such a manner that center of gravity of the first unit along the second direction is located between the supports whether the second unit is retracted in, or drawn out of, the first unit drawn out of the main unit.

DETAILED DESCRIPTION

Image recording apparatus according to preferred embodiments will be described below with reference to the accompanying drawings.

Figure 1:
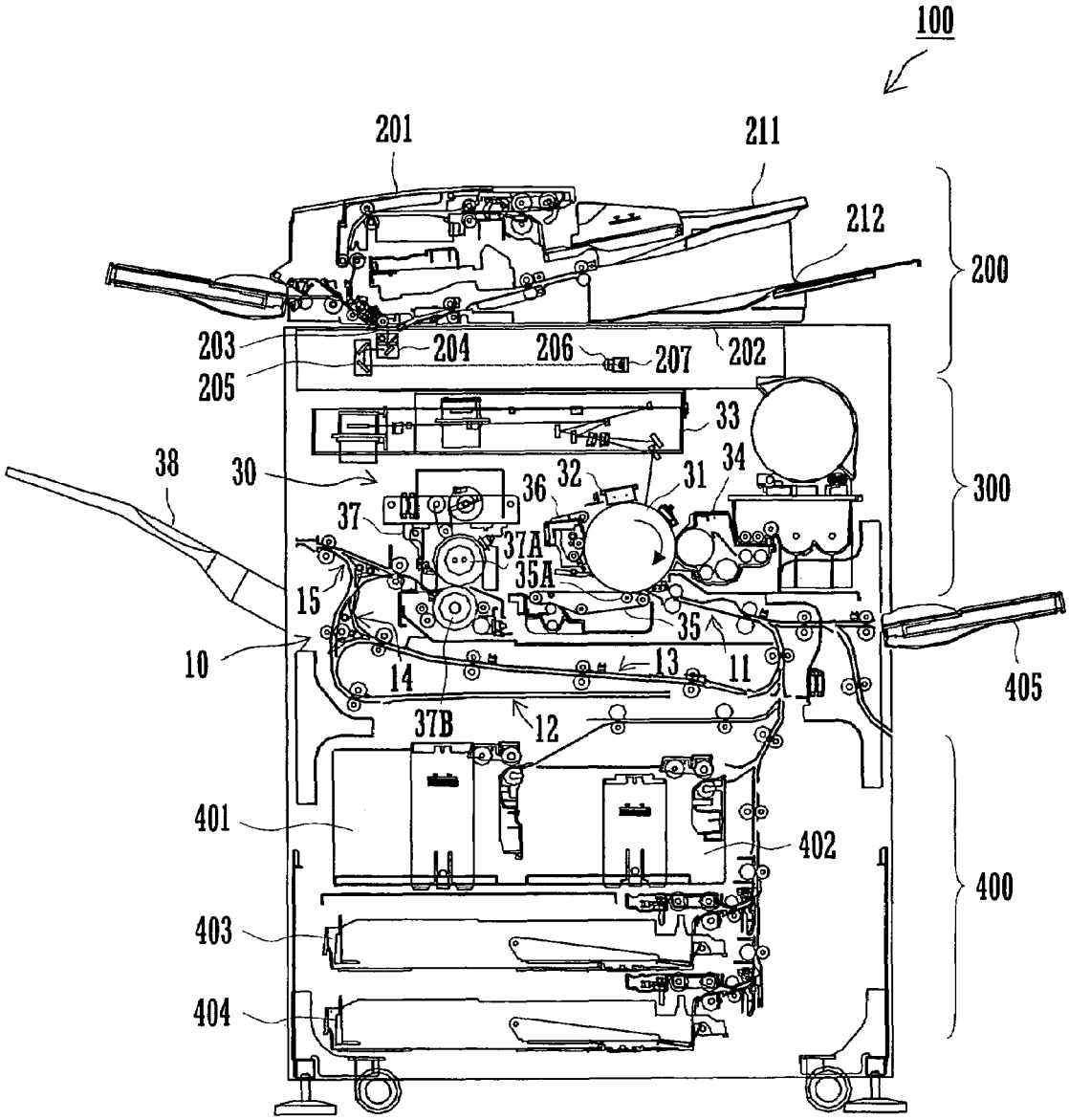
FIG. 1 is a schematic front cross-sectional view illustrating a configuration of an image recording apparatus according to an example non-limiting embodiment.

FIG. 1 is a schematic front cross-sectional view illustrating a configuration of an image recording apparatus according to a first non-limiting embodiment, such as an apparatus 100. The apparatus 100 includes an image reading unit 200, an image forming unit 300, and a sheet feeding unit 400.

The unit 200 has an automatic document feeder (ADF) 201, a first document platen 202, a second document platen 203, a first mirror base 204, a second mirror base 205, a lens 206, and a charge coupled device (CCD) 207.

The ADF 201 feeds an original document, sheet by sheet, from a document tray 211 through the second document platen 203 to a first output tray 212. The ADF 201 is mounted so as to be pivotable about a rear-end pivot between an open position and a closed position. In the closed position, the ADF 201 covers the platen 202. The ADF 201 is pivoted upward to the open position to expose the platen 202, so that a user can place an original document manually on the platen 202.

Each of the platens 202 and 203 includes a hard glass plate.

The bases 204 and 205 are provided below the platens 202 and 203 so as to be movable horizontally. The base 205 moves half as fast as the base 204. On the base 204, a light source and a first mirror are mounted. On the base 205, a second mirror and a third mirror are mounted.

In reading an image of original document that is being transported by the ADF 201, the base 204 is held still below the platen 203. While passing on the platen 203, an original document is irradiated with light from the light source. The reflected light is in turn reflected from the first mirror to the base 205.

In reading an image of original document placed on the platen 202, the bases 204 and 205 are moved horizontally below the platen 202. An original document placed on the platen 202 is irradiated with light from the light source. The reflected light is in turn reflected from the first mirror to the base 205.

Regardless of whether an original document is fed by the ADF 201 or placed on the platen 202, thus, the reflected light from the original document is in turn reflected from the second and third mirrors, and then strikes the CCD 207 through the lens 206.

The CCD 207 outputs electric signals according to an amount of the reflected light from the original document. The electric signals are input to the image forming unit 300 as image data.

The unit 300 is provided with an image recording section 30. The section 30 includes a photoreceptor drum 31, a charging device 32, an exposure device 33, a developing device 34, a transfer belt 35, a cleaner 36, and a fusing device 37. The drum 31, which has an outer photoreceptive surface, is rotatable in a direction indicated by an arrow. The charging device 32 applies, to the surface of the drum 31, such a voltage as to allow the surface to have a uniform electric potential. The device 32 may be either a noncontact charger, or a contact charger of roller or brush type.

The exposure device 33 irradiates the surface of the drum 31 with light modulated according to image data, so that an electrostatic latent image is formed on the surface. The device 33 has a polygon mirror through which to scan the drum 31 axially with a laser light modulated according to image data. Alternatively, an exposure device provided with an array of light emitting elements such as ELs or LEDs may be used as the device 33.

The developing device 34 supplies toner to the surface of the drum 31 and develops the electrostatic latent image into a toner image.

Under the drum 31, the transfer belt 35 is looped over a plurality of rollers. The belt 35 has a resistance of $1*10^9$ Ω·cm to $1*10^{13}$ Ω·cm. Inside the loop of the belt 35, a transfer roller 35A is provided so as to be pressed against the drum 31 through the belt 35. A predetermined amount of transfer voltage is applied to the roller 35A, so that a toner image is transferred from the drum 31 to a sheet that passes between the belt 35 and the drum 31.

The cleaner 36 removes residual toner that remains on the drum 31 after a toner image is transferred from the drum 31 to a sheet.

The fusing device 37 has a heat roller 37A and a pressure roller 37B. The roller 37A is heated, by an internal heater, to a sufficient temperature to melt toner. The roller 37B is pressed against the roller 37A at a predetermined pressure. The device 37 heats and pressurizes a sheet passing between the rollers 37A and 37B, thereby firmly fixing a toner image to the sheet. After passing through the device 37, a sheet is output to a second output tray 38 mounted on a side surface of the apparatus 100. The tray 38 corresponds to the sheet output section of the invention.

The sheet feeding unit 400 has sheet cassettes 401, 402, 403, and 404, and a manual sheet feeding tray 405. Each of the cassettes 401 to 404 holds a plurality of sheets of the same size. The tray 405 is provided for holding sheets of sizes and types that are used infrequently.

The unit 400 feeds sheets, one by one, from any one of the cassettes 401 to 404 and the tray 405. A sheet fed by the unit 400 is transported to the image recording section 30 along a sheet transport path 10 to be described below.

Figure 2:
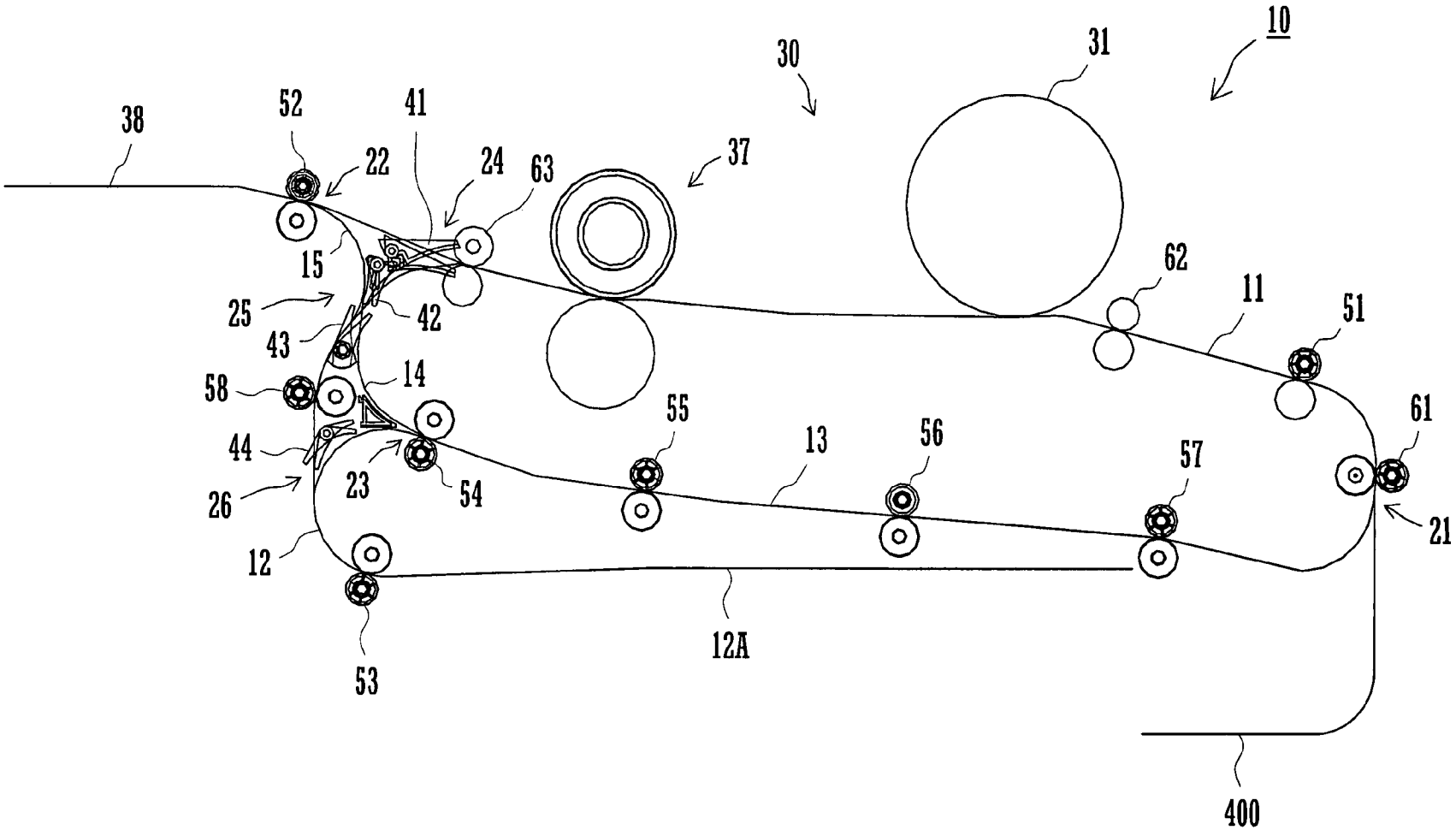
FIG. 2 is a diagram illustrating a configuration of a sheet transport path provided in the apparatus.

FIG. 2 is a diagram illustrating a configuration of the sheet transport path 10. The path 10 is provided inside the image forming unit 300. The path 10 includes a first path 11, a second path 12, a third path 13, a fourth path 14, and a fifth path 15.

The first path 11 leads from the unit 400 to the tray 38, through a first confluence 21, the section 30, a first bifurcation 24, and a second confluence 22 in that order. Arranged along the path 11 are transport rollers 61, 62, and 63, a registration roller 51, and an output roller 52. The transport rollers 61 to 63, the registration roller 51, and the output roller 52 are driven by a first motor (not shown).

A portion of the path 11 located in the section 30 is in an approximately horizontal position. In the portion, the belt 35 is arranged for stable transfer of toner image from the drum 31 to a sheet and for stable transport of a sheet with an pre-fusion toner image electrostatically attracted thereto.

The first bifurcation 24 is located between the section 30 and the tray 38. The second path 12 leads from the bifurcation 24 to a switchback section 12A, through a second bifurcation 25 and a third bifurcation 26 in that order. The section 12A is located below and parallel to the portion of the path 11 located in the section 30. The section 12A transports a sheet forwards and backwards therealong. Along the path 12, there are provided reversing rollers 53 and 58. The rollers 53 and 58 are selectively driven in a frontward direction or a backward direction through a first clutch (not shown) by a second motor (also not shown).

The third path 13 leads from the third bifurcation 26 to the first confluence 21 through a third confluence 23. The path 13 is located between the section 12A and the portion of the path 11 located in the section 30. Along the path 13, transport rollers 54, 55, 56, and 57 are arranged. The rollers 54 to 57 are selectively driven in a frontward direction or a backward direction through a second clutch (not shown) by a third motor (also not shown).

The fourth path 14 leads from the bifurcation 25 to the confluence 23. The fifth path 15 leads from the bifurcation 25 to the confluence 22.

Figure 3:
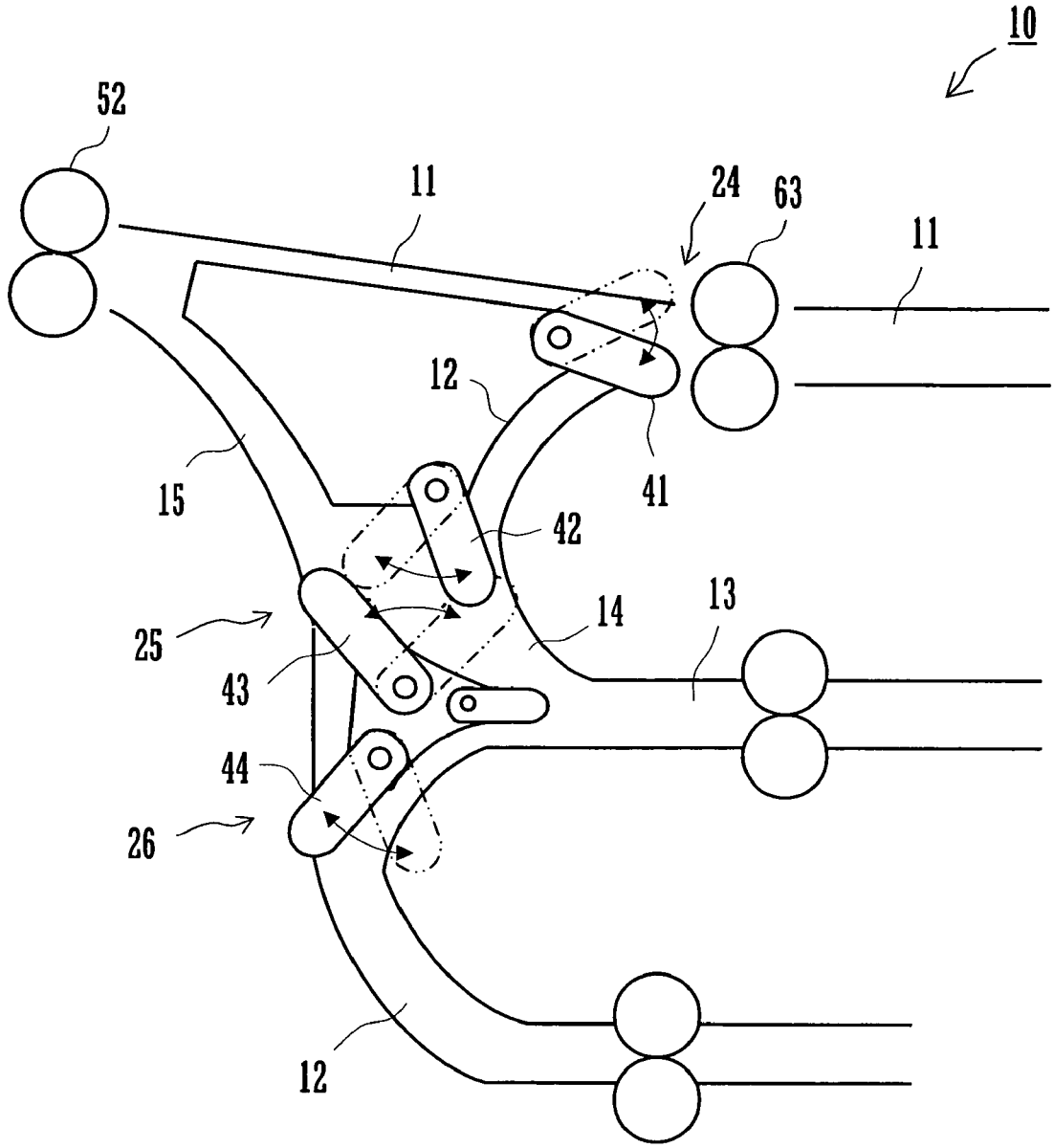
FIG. 3 is a diagram illustrating a configuration of each of first, second, and third bifurcations of the sheet transport path.

FIG. 3 is a diagram illustrating a configuration of each of the first bifurcation 24, the second bifurcation 25, and the third bifurcation 26, of the sheet transport path 10. A guide 41 is provided at the bifurcation 24. The guide 41 is pivoted between two respective positions indicated by a solid line and a chain double-dashed line by a first solenoid (not shown), to guide a sheet from the bifurcation 24 into either one of the paths 11 and 12.

Guides 42 and 43 are provided at the bifurcation 25. With no external force acting thereon, the guide 42 is located in a position, indicated by a solid line, to guide a sheet into the path 15 as the sheet is transported upward along the path 12 or the path 14. The guide 42 prevents a sheet from being guided into the path 12 as the sheet is transported upward along the path 12 or the path 13.

The guide 43 is pivoted between two respective positions indicated by a solid line and a chain double-dashed line by activating and deactivating a second solenoid (not shown), to allow, in the bifurcation 25, passage of a sheet from the path 14 to the path 15 or from the path 12 to the path 15.

The guide 42 is pivoted to a position indicated by a chain double-dashed line, by contact with a sheet that is transported downward from the bifurcation 24 along the path 12. A guide 44 is provided at the bifurcation 26. A sheet reversed in the section 12A is never delivered to the tray 38 through the paths 12 and 15. Thus, the roller 58 is rotatable in one direction only, and the guide 44 is urged to a position indicated by a solid line by an elastic member. The elastic member exerts such an elastic force on the guide 44 as to allow the guide 44 to be pivoted to a position indicated by a chain double-dashed line by contact with a sheet that is transported to the portion 12A through the paths 11 and 12. In the bifurcation 26, accordingly, the guide 44 selectively allows passage of a sheet from the path 12 to the path 13, or through the path 12.

The apparatus 100 is designed to perform three types of sheet transport processes: a normal transport process in which a sheet is transported on the path 11, undergoes image recording process on a single side thereof, and then is output to the tray 38 with the image-recorded side facing up; a face-down transport process in which a sheet is output to the tray 38 with an image-recorded side facing the tray 38 so that the image-recorded side cannot be seen; and a reverse transport process in which a sheet undergoes image recording process on both sides thereof.

The face-down transport process is performed as follows. After undergoing image recording process in the section 30, a sheet is transported through the first bifurcation 24, the path 12, the section 12A, the path 12, the second bifurcation 25, the path 15, and the second confluence 22, in that order, and then output to the tray 38. Alternatively, the face-down transport process can be performed as follows. After undergoing image recording process in the section 30, a sheet is transported through the bifurcation 24, the path 12, the bifurcation 25, the path 14, the path 13, the path 14, the bifurcation 25, the path 15, and the confluence 22, in that order.

Meanwhile, the reverse transport process is performed as follows. After undergoing image recording process on a first side in the section 30, a sheet is transported through the bifurcation 24, the path 12, the section 12A, the path 12, the third bifurcation 26, the first confluence 21, and the path 11, in that order, to be reversed. Then, the sheet undergoes image recording process on a second side in the section 30, and output to the tray 38.

It is to be noted that the path leading from the bifurcation 24 to the confluence 21 through the paths 12 and 13 in the reverse transport operation corresponds to the second path as the reversing transport path.

Figure 4:
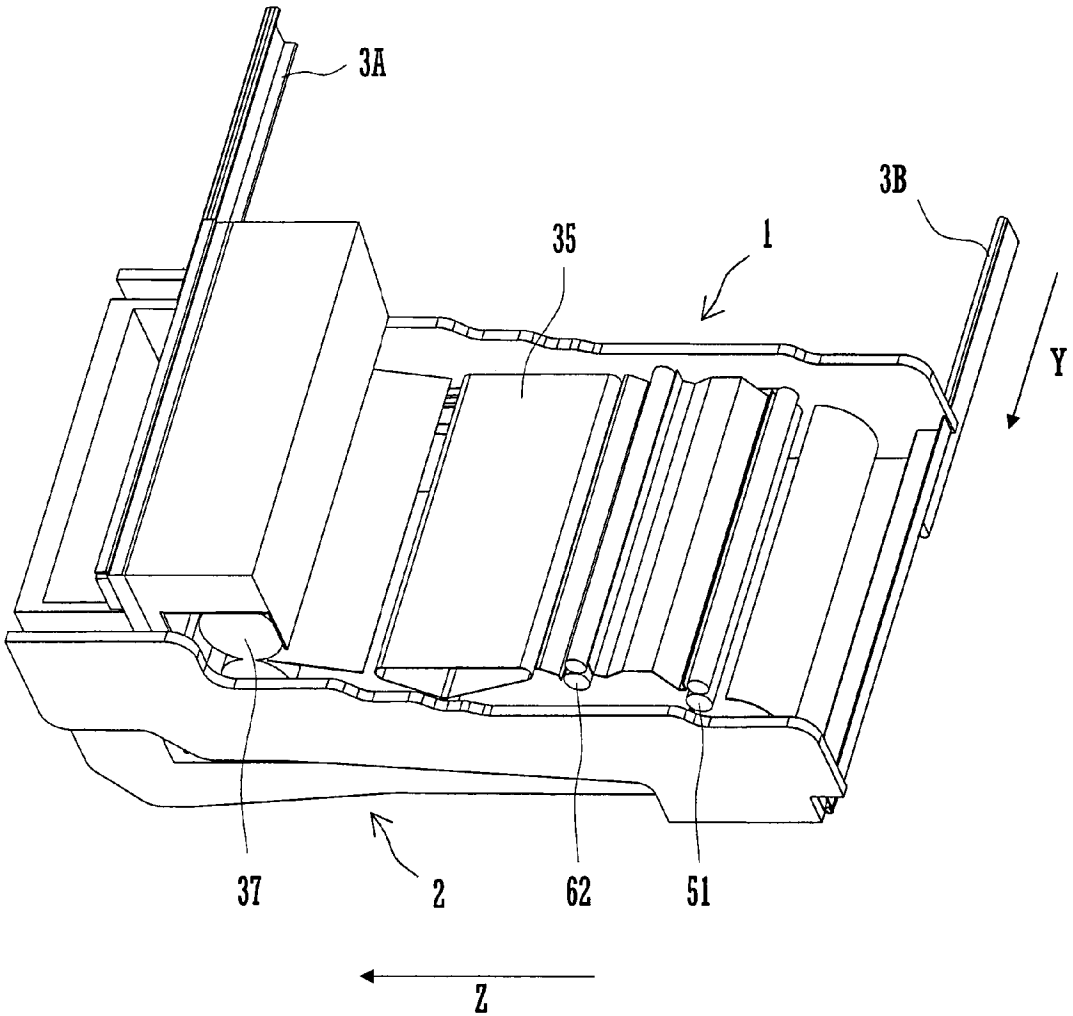
FIG. 4 is an external view of the apparatus illustrating a first unit, and a second unit, as detached from the apparatus.

FIG. 4 is an external view illustrating a first unit 1, and a second unit 2, drawn out of the apparatus 100. The units 1 and 2 are mounted inside the apparatus 100. In the first unit 1, the transfer belt 35, the transfer roller 35A, and the fusing device 37 are positioned. The unit 1 is slidably supported by sliding rail assemblies 3A and 3B. The assemblies 3A and 3B allow the unit 1 to be brought out of the apparatus 100 by being pulled in a direction of arrow Y toward the front (i.e., the outside) of the apparatus 100.

Figure 6:
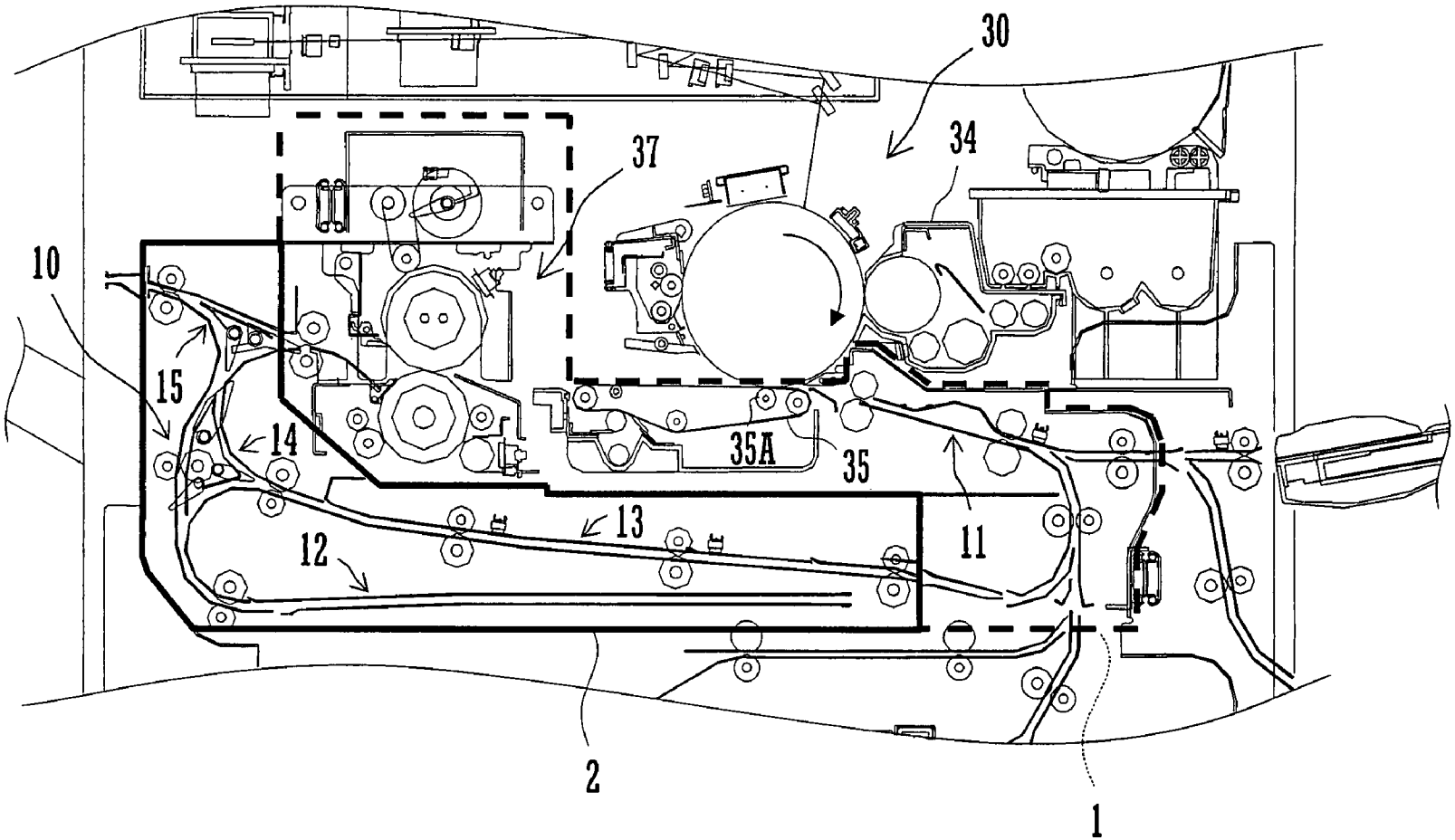
FIG. 6 is a partial enlarged view of the apparatus.

In the unit 1, referring to FIG. 6, the portion of the first path 11 located in the section 30, and a portion of the third path 13, are positioned. When the unit 1 is drawn out of the apparatus 100, the portion of the path 11 located in the section 30 is exposed, as shown in FIG. 4. In the event of sheet jam or the like, thus, a user can easily check whether a sheet is present or absent in the portion, and, if necessary, remove a sheet present in the portion, by merely drawing the unit 1 out of the apparatus 100.

The assemblies 3A and 3B are mounted on the unit 1, parallel to the direction of arrow Y and at a predetermined spacing, with the assembly 3A located at a higher level than the assembly 3B. In the present embodiment, a precision ball bearing slide rail assembly is used as each of the assemblies 3A and 3B. This allows the unit 1 smoothly to be retracted into, and drawn out of, the apparatus 100 without excess force being applied to the assemblies 3A and 3B and to the unit 1.

Figure 5:
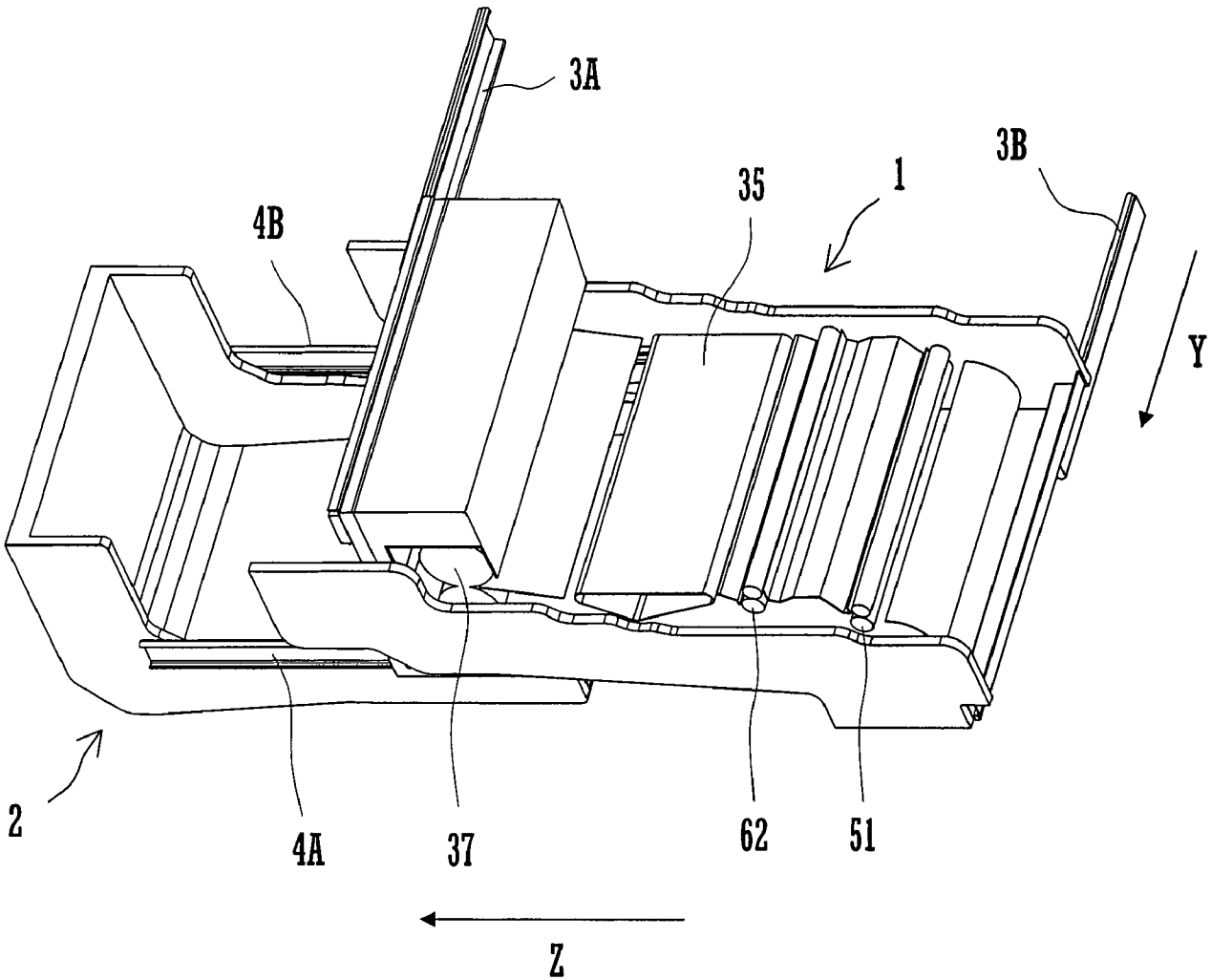
FIG. 5 is an external view of the apparatus illustrating a second unit detached from the first unit.

Referring to FIG. 6, the second unit 2 has a portion of the path 11, the entire path 12, a portion of the path 13, the entire path 14, and the entire path 15, positioned therein. Referring to FIG. 5, the unit 2 is slidably supported by sliding rail assemblies 4A and 4B. With the unit 1 drawn out of the apparatus 100 as shown in FIG. 4, the unit 2 can be drawn out of the unit 1 by being moved in the direction of arrow Z, which is substantially perpendicular to the direction of arrow Y. In the present embodiment, a precision ball bearing slide rail assembly is also used as each of the assemblies 4A and 4B. The assemblies 4A and 4B can also be referred to as guide mechanism.

Figure 7:
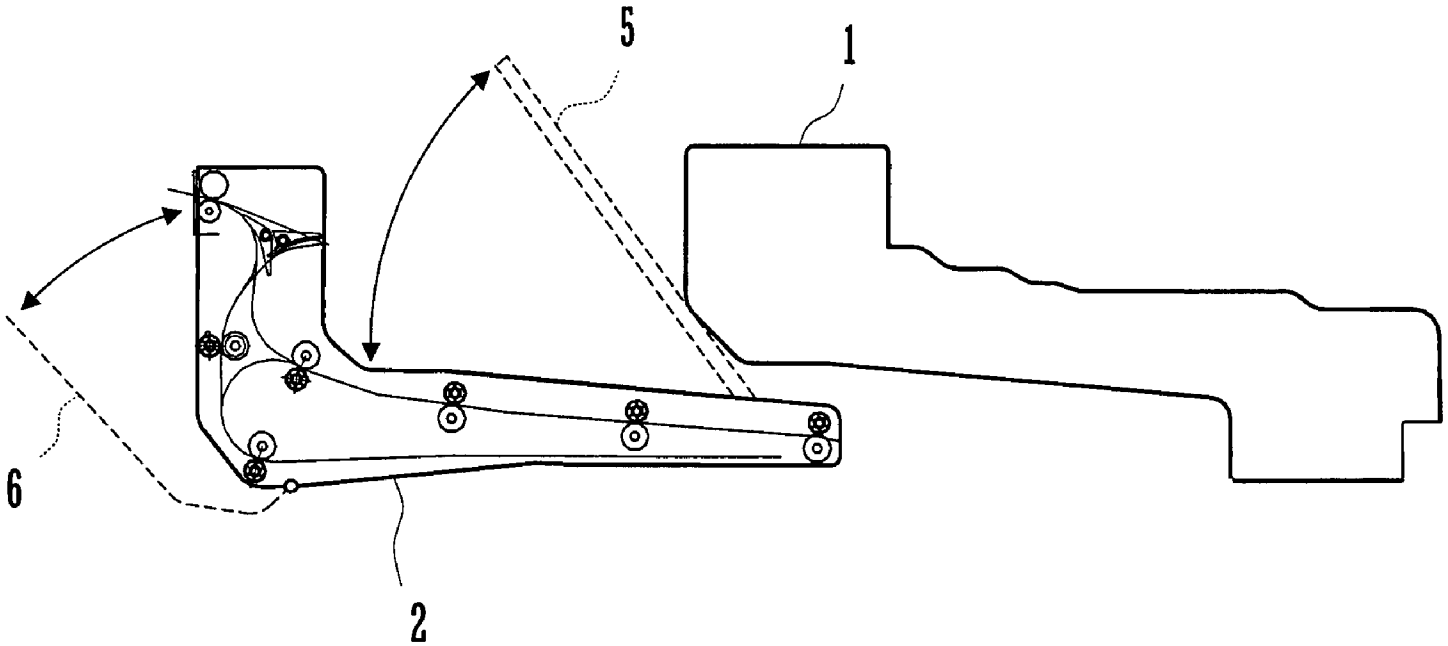
FIG. 7 is a schematic drawing illustrating a configuration of the second unit.

The unit 2 has an upper movable plate 5 and a side movable plate 6. With the unit 2 drawn out of the unit 1 as shown in FIG. 7, each of the plates 5 and 6 is rendered pivotable between a closed position and an open position indicated by a solid line and a broken line, respectively. The plates 5 and 6 are pivoted to the open positions to expose a portion of the path 12 and a portion of the path 13.

A sheet jam is relatively more likely to occur in the first bifurcation 24, the second bifurcation 25, and the third bifurcation 26, which are arranged in the order along the portion of the path 12. The plate 6 is pivoted to the open position to expose all of the bifurcations 24 to 26 to the outside and provide access to the bifurcations 24 to 26. This facilitates removal of a sheet present in the paths 12 and 13 in the event of a sheet jam.

Figure 8A:
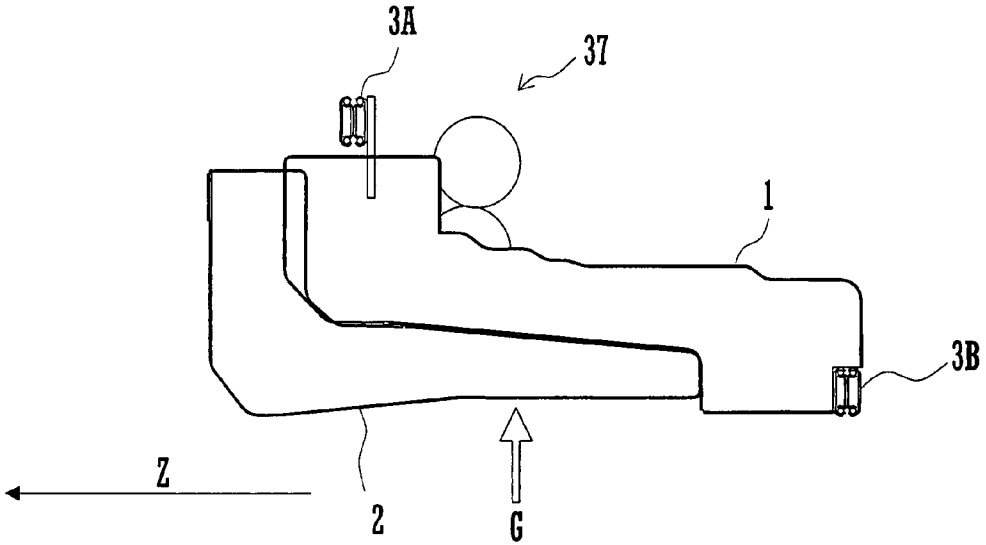
FIGS. 8A and 8B are schematic front views showing centers of gravity of the first unit.
Figure 8B:
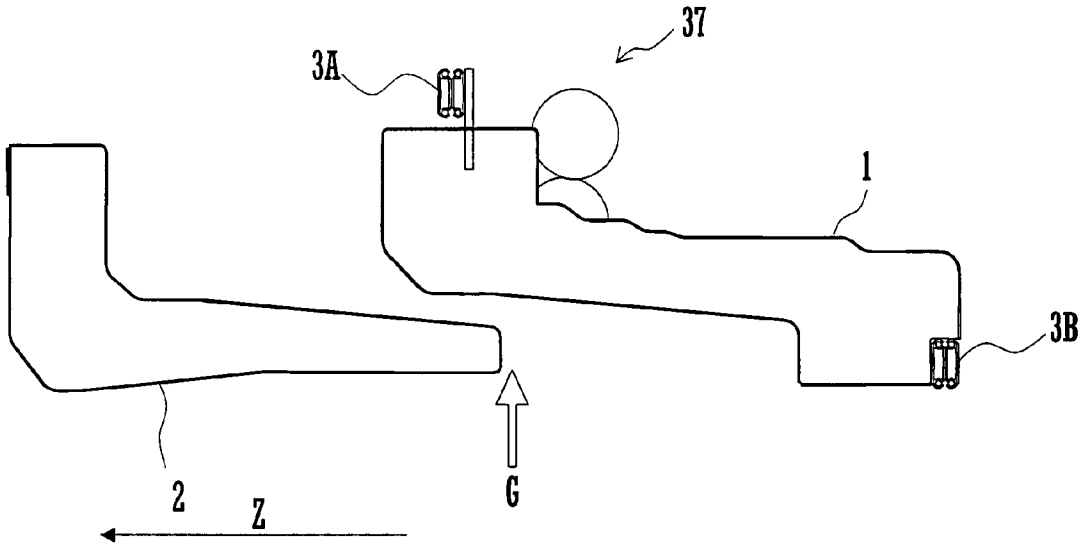

FIGS. 8A and 8B are schematic front views showing positions of centers of gravity of the unit 1. In FIG. 8A, the unit 1 is drawn out of the apparatus 100. In FIG. 8B, the unit 2 is drawn out of the unit 1. With the unit 2 retracted in the unit 1 as shown in FIG. 8A, a center of gravity G of the unit 1 is located nearer to the center thereof with respect to a position where the fusing device 37 is located.

With the unit 2 drawn out of the unit 1 as shown in FIG. 8B, the center of gravity G is located between the device 37 and the assembly 3A. The center of gravity G is located more to the right of the sheet of FIG. 8B with respect to the assembly 3A because the unit 1 itself is heavier in weight than the unit 2 due to heavy components, such as the device 37, positioned in the unit 1.

Whether the unit 2 is retracted in or drawn out of the unit 1, thus, the center of gravity G remains between the assemblies 3A and 3B. Therefore, movement of the unit 2 in and out of the apparatus 100 causes little change in force required for the assemblies 3A and 3B to support the unit 1. This allows the unit 1 to be stably supported, and thus contributes to maintaining a high accuracy of positioning the units 1 and 2 with respect to the apparatus 100 over a long term.

It is to be noted that the center of gravity G remains at the same point whether the unit 1 is retracted in or drawn out of the apparatus 100. Also, along the direction of arrow Y, a center of gravity of the unit 1 remains unchanged whether the unit 2 is retracted in, or drawn out of, the unit 1.

In the present embodiment, as described earlier, the assemblies 3A and 3B are arranged, parallel to the direction of arrow Y and at a predetermined spacing, with the assembly 3A located at a higher level than the assembly 3B. This arrangement is advantageous over an arrangement where slide rail assemblies are arranged horizontally or vertically. It is because this arrangement prevents a shift in the center of gravity G along the direction of arrow Z from causing excessive load on one of the assemblies 3A and 3B, and allows little change in moment load. This arrangement thus provides stable support to the unit 1. This arrangement is particularly advantageous in the present embodiment because the assembly 3A, from the side of which the unit 2 is drawn out of the unit 1, is positioned at a higher level than the assembly 3B.

This allows a high accuracy of positioning the units 1 and 2 with respect to the apparatus 100 to be maintained over a long term. This arrangement is particularly advantageous because a force to draw the unit 2 out of the unit 1 also acts on the unit 1. The positioning of the assemblies 3A and 3B as the support members includes, but is not limited to that as described above in the present embodiment. It is only necessary to arrange at least two support members at different positions along the direction of arrow Z, with a first support member at a higher level than a second support member. For example, four support members may be arranged at at least two different positions along the direction of arrow Z, and at at least two different levels.

In the present embodiment, the assembly 3A is higher in strength than the assembly 3B. In the unit 1, the fusing device 37, which is also referred to as the load-applying member, is positioned on the side where the unit 2 is drawn out from the unit 1. Located along the sheet transport path 10, the device 37 is heavier in weight than the other components located along the path 10. Thus, the center of gravity G is located not on the center of the unit 1 but on the side thereof where the unit 2 is drawn out and where the assembly 3A is mounted. The high strength of the assembly 3A reduces degradation of the assemblies 3A and 3B due to repeated use over a long term.

Also, the device 37, which doubles as the load-applying member, eliminates the need for an additional load-applying device and thus prevents an increase in production cost involved by provision of such additional device.

Figure 9:
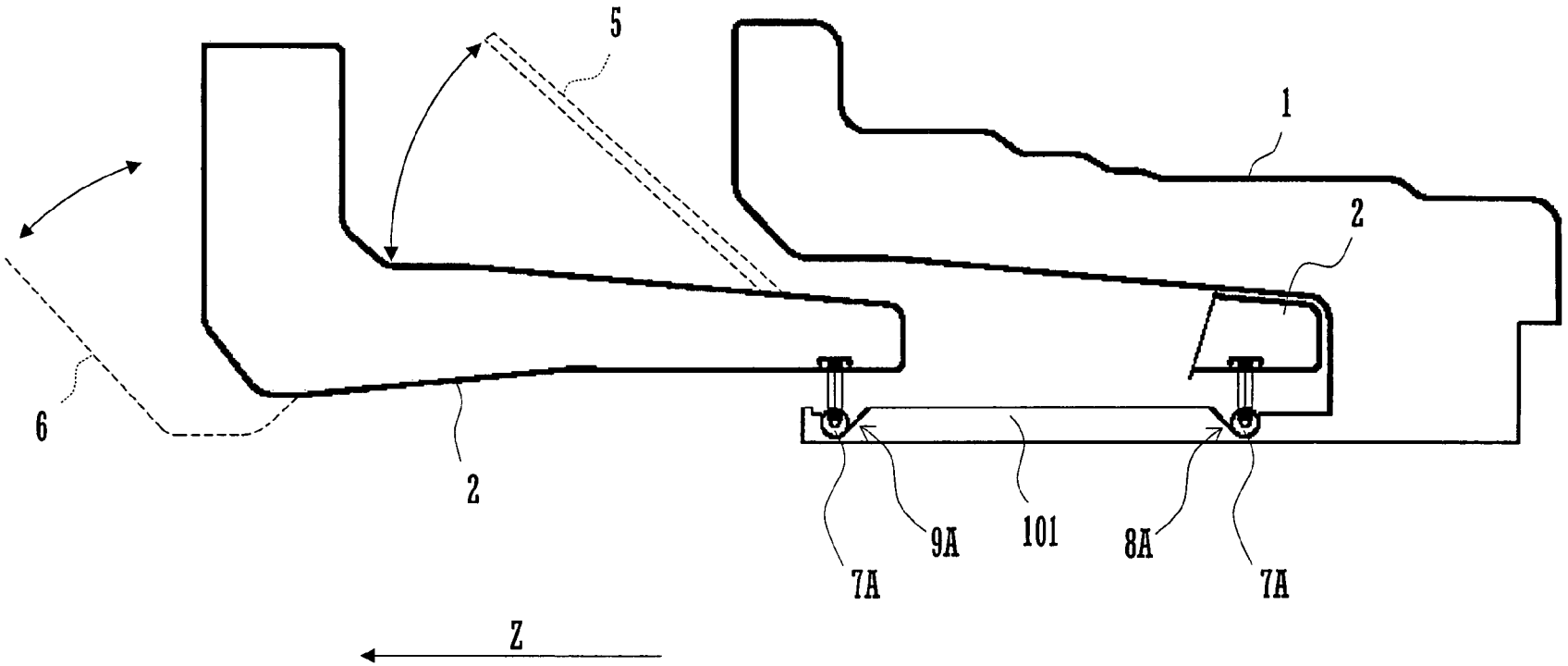
FIG. 9 is a schematic cross-sectional view illustrating the configuration of the second unit.

Next, a second non-limiting embodiment will be described below, where the same elements have the same legends as in the first embodiment. FIG. 9 is a schematic drawing illustrating the configuration of a second unit 2 according to the second embodiment. The unit 2 has two wheels 7A and 7B. A first unit 1 has a plate 101 provided with first recesses 8A and 8B and second recesses 9A and 9B. The wheel 7B, the first recess 8B, and the second recess 9B are not shown in the figure.

Figure 10C:
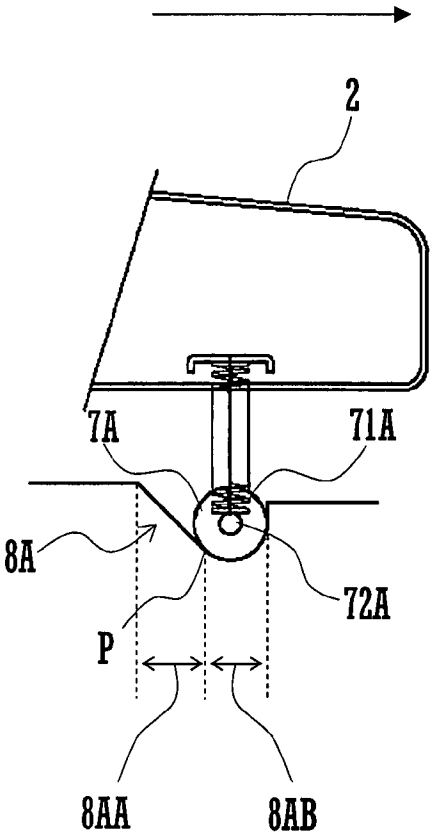
FIGS. 10A to 10C are drawings illustrating how a wheel is engaged with a first recess.
Figure 10B:
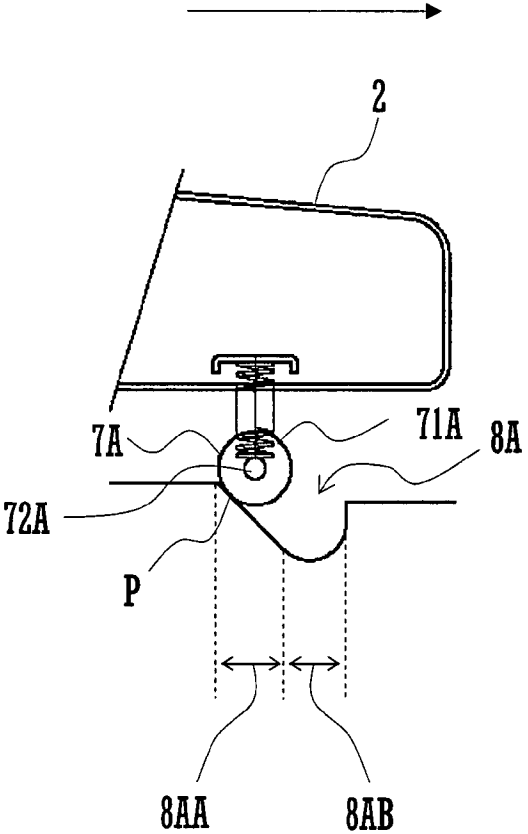
Figure 10A:
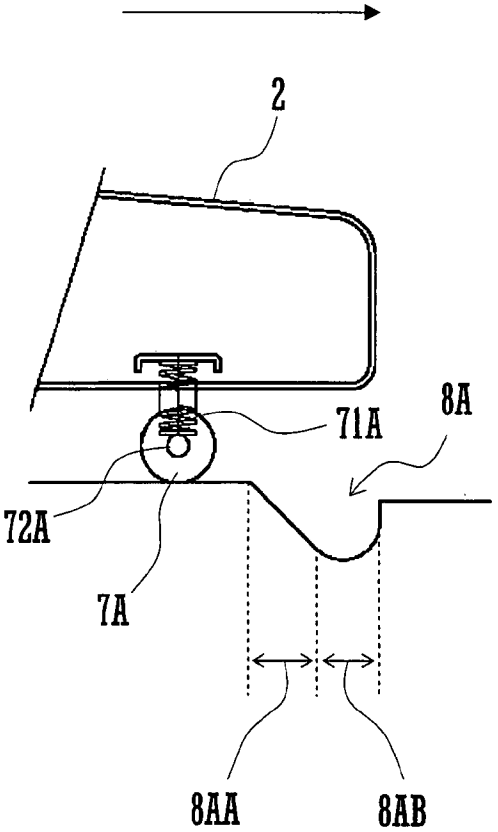

The wheels 7A and 7B are mounted on an outer surface of the unit 2 facing the plate 101. Referring to FIGS. 10A to 10C, the wheels 7A and 7B are supported by rotating shafts 72A and 72B, respectively, in such a manner as to be rotated, and moved together with the unit 2. The shaft 72B is not shown in the figures. The shafts 72A and 72B are supported, by a guide member (not shown), movably along a direction in which the wheels 7A and 7B are urged against the plate 101 by springs 71A and 71B. The spring 71B is not shown. Thus, the wheels 7A and 7B are rotated, and moved along the direction of arrow Z, while in contact with the plate 101.

The plate 101 is provided on an outer surface of the unit 1 so as to face the wheels 7A and 7B. As described earlier, the plate 101 is provided with the first recesses 8A and 8B, and the second recesses 9A and 9B. The recesses 8A, 9A and 8B, 9B are engaged with the wheels 7A and 7B, respectively, to hold the unit 2 to the unit 1 so that the unit 2 does not move. It is to be noted that the lock mechanism of the Claims includes the wheels 7A and 7B, the first recesses 8A and 8B, the second recesses 9A and 9B, and the springs 71A and 71B.

FIGS. 10A to 10C are drawings illustrating how the wheel 7A becomes engaged with the recess 8A. The recess 8A has an inclined surface 8AA, and a concavity 8AB that is contiguous with the surface 8AA. Referring to FIG. 10A, the spring 71A becomes compressed when the unit 2 is moved in a direction opposite to the direction of arrow Z to be retracted in the unit 1.

In the course of the unit 2 being retracted in the unit 1, referring to FIGS. 10A to 10C, the spring 71A exerts a force to urge the wheel 7A against the surface 8AA while the wheel 7A is being guided to the concavity 8AB to become engaged with the recess 8A. Thus, the unit 2 is fully retracted in, and held to, the unit 1.

When the wheel 7A is in engagement therewith, the recess 8A serves as a stopper to prevent the unit 2 from being pushed further into the unit 1. Meanwhile, when the unit 2 is to be drawn out of the unit 1, force is applied in the direction of arrow Z in order to pull up the wheel 7A along the surface 8AA and disengage the wheel 7A from the recess 8A. The disengagement is facilitated by the fact that a contact point P between the surface 8AA and the wheel 7A is positioned at a lower level than that of the center of the wheel 7A. In this regard, the wheel 7A is not readily disengaged from the recess 8A by merely moving the unit 2 in the direction of arrow Z, if the contact point P is positioned at a higher level than that of the center of the wheel 7A.

The wheel 7A, also referred to as the projection, prevents an increase in contact resistance caused by contact with the surface 8AA when the unit 2 is moved. This further facilitates disengagement of the wheel 7A from the recess 8A.

Figure 11:
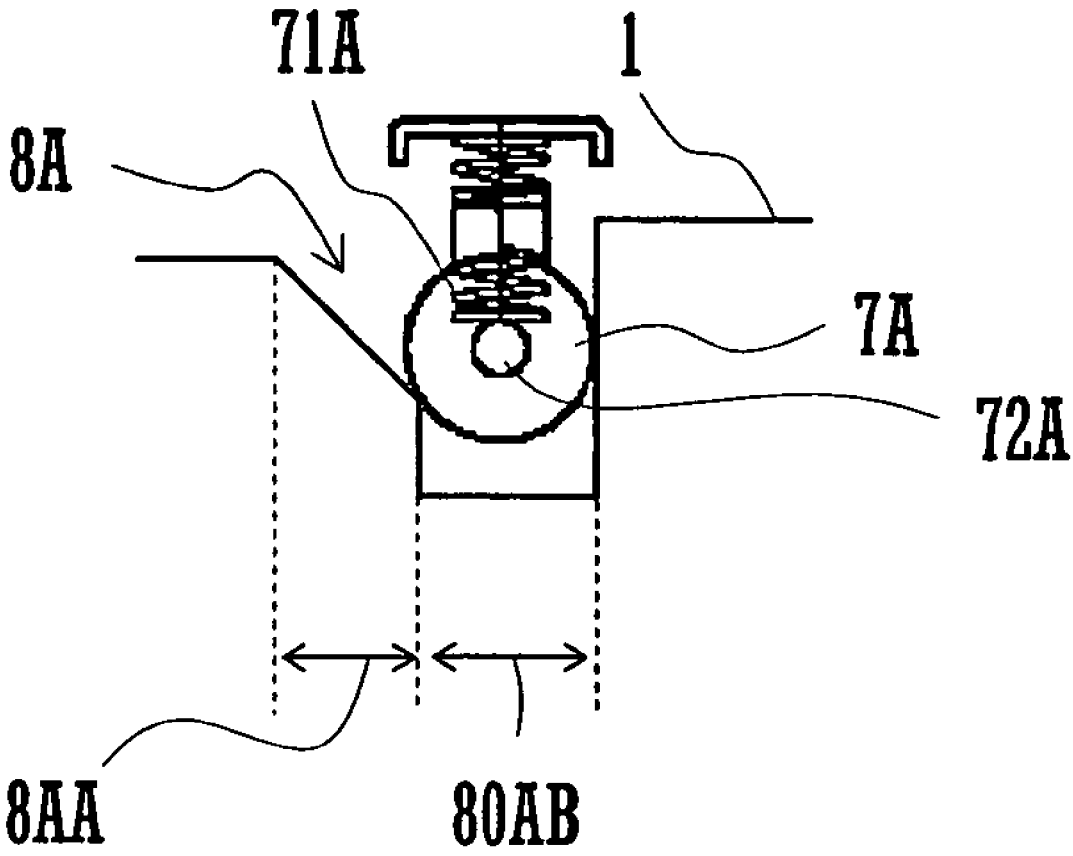
FIG. 11 is a drawing illustrating how a wheel is engaged with a first recess.

Referring to FIGS. 10A to 10C, the concavity 8AB has a cross section of circular arc. Alternatively, the concavity 8AB may have a cross section of such shape as to allow the contact point P to be positioned at a lower level than that of the center of the wheel 7A. For example, the concavity 80AB may have a cross section of such rectangle as shown in FIG. 11.

It is to be noted that the wheel 7B and the first recess 8B are similar in configuration to the wheel 7A and the recess 8A, respectively. The recesses 9A and 8A are formed to have vertical cross sections in the direction of arrow Z that are symmetric with respect to a line. This is also the case with the recesses 9B and 8B. When fully drawn out of the unit 1, the unit 2 is held to the unit 1 by engagement of the recesses 9A and 9B with the wheels 7A and 7B, respectively. In this state, the recesses 9A and 9B serve as stoppers to prevent the unit 2 from being further pulled out of the unit 1.

The simple configuration as described above ensures precise positioning of the units 1 and 2 as well as safety of operators. This configuration is particularly advantageous because part of the sheet transport path 10 is positioned in the units 1 and 2.

Figure 12:
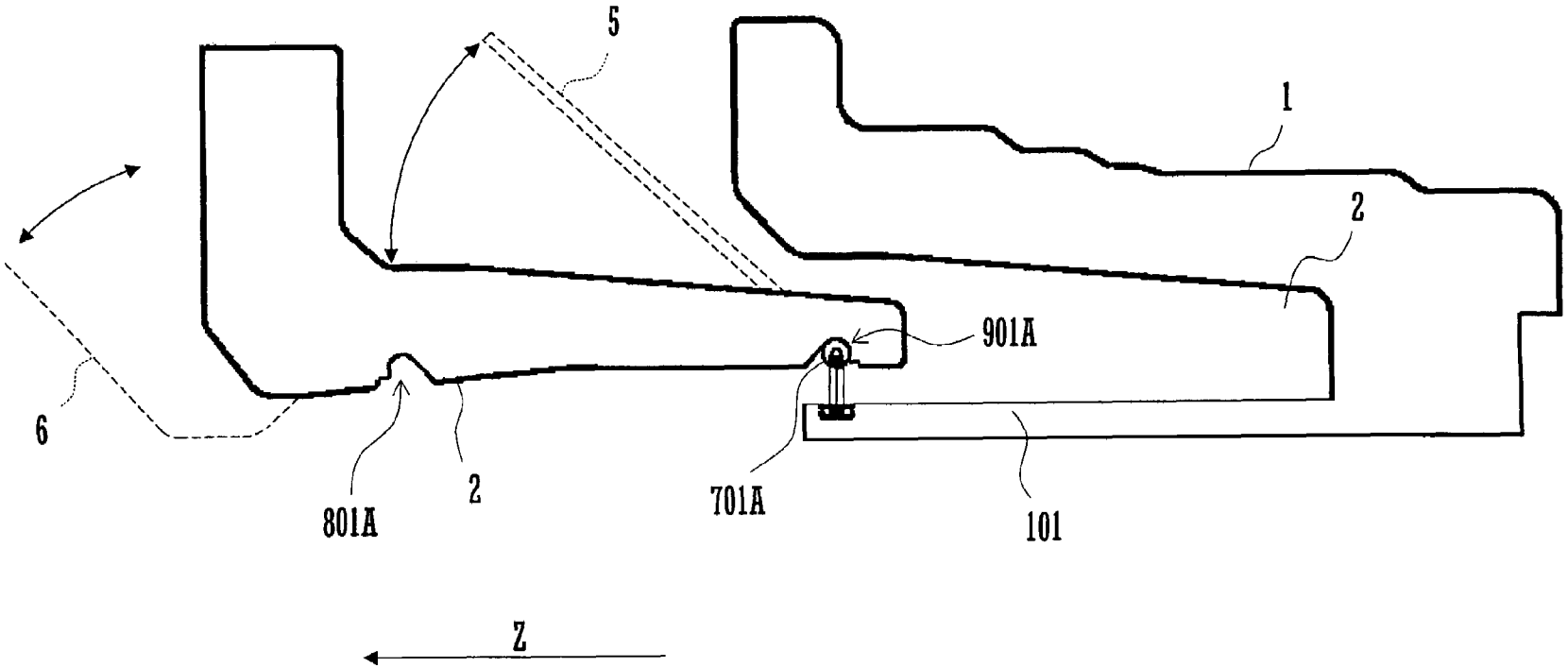
FIG. 12 is a schematic cross-sectional view of a projection.

In the present embodiment, the wheels 7A and 7B are mounted on the outer surface of the unit 2 facing the plate 101, and the first recesses 8A and 8B and the second recesses 9A and 9B are provided on the outer surface of the unit 1. Alternatively, first recesses 801A and 801B and second recesses 901A and 901B may be provided on the outer surface of the unit 2, and the wheels 701A and 701B may be mounted on the outer surface of the unit 1, as shown in FIG. 12. It is to be noted that combination of at least one wheel, at least one first recess, and at least one second recess suffices.

Figure 13:
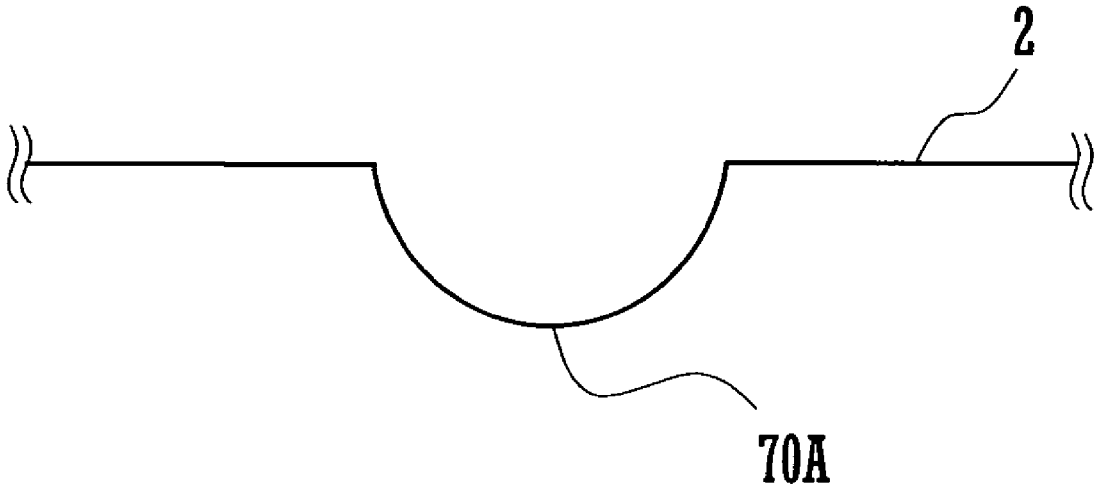
FIG. 13 is a schematic side view illustrating a configuration of the second unit.

Also, it is to be noted that the projection includes, but is not limited to, the wheels 7A and 7B as used in the present embodiment. Any member suffices as the projection, provided that the member is provided on a surface of one of the units 1 and 2 facing a surface of the other so as to have contact with the latter surface, and has a portion projecting toward the latter surface. For example, projections 70A and 70B may be provided that project toward the unit 1 as shown in FIG. 13 (the projection 70B is not shown).

Figure 14A:
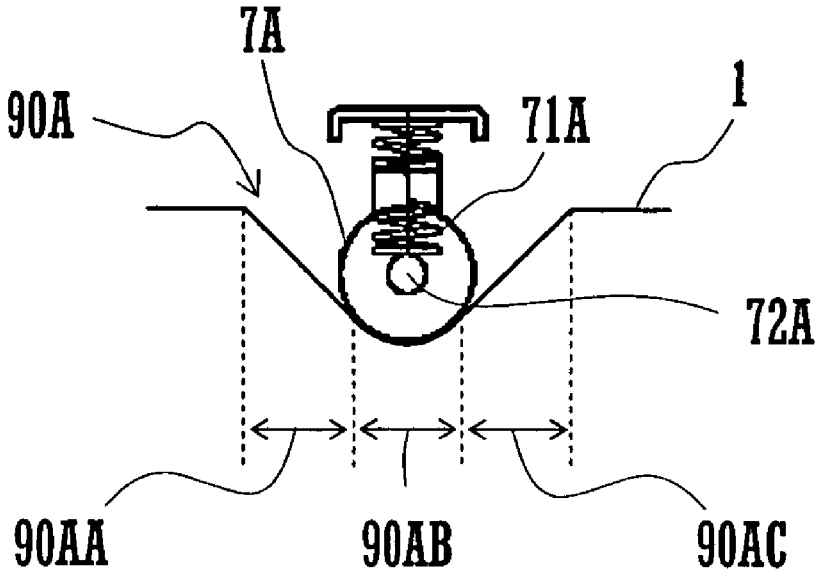
FIGS. 14A and 14B are drawings illustrating how wheels are engaged with respective recesses.
Figure 14B:
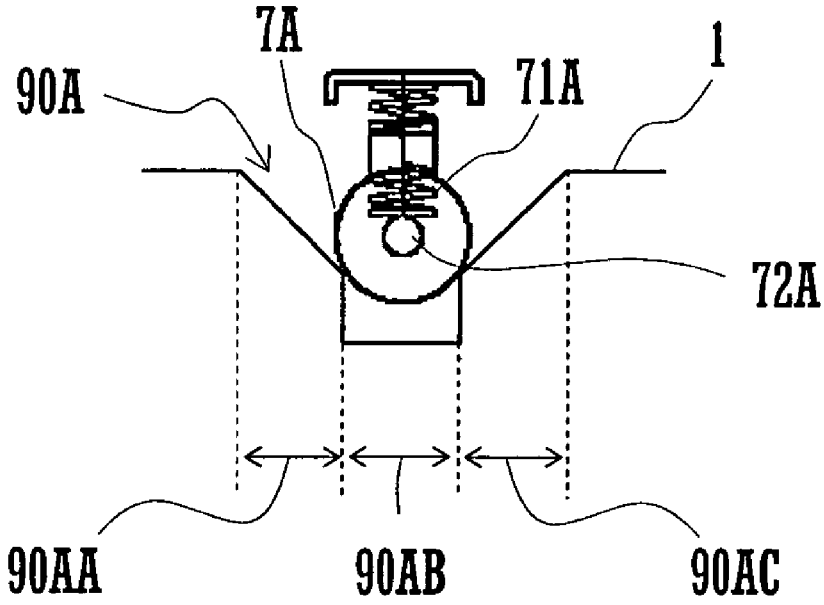

In the present embodiment, further, the recesses 9A and 9B are provided at such positions as to become engaged with the wheels 7A and 7B, respectively, when the unit 2 is fully drawn out of the unit 1. Alternatively, the recesses 9A and 9B may be provided at such positions as to become engaged with the wheels 7A and 7B, respectively, when the unit 2 is drawn out to a predetermined position from the unit 1. Referring to FIGS. 14A and 14B, for example, second recesses 90A and 90B (the recess 90B not shown in the figures) may be provided at such positions as to become engaged with the wheels 7A and 7B, respectively, when the unit 2 is located at an intermediate position between the retracted and drawn-out positions.

The second recess 90A has inclined surfaces 90AA and 90AC, and a concavity 90AB formed therebetween, thereby allowing the wheel 7A to be moved in both of the direction of arrow Z and the opposite direction. The recess 90B is similar in configuration to the recess 90A.

The embodiments being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A unit drawing mechanism adapted for installation in an image recording apparatus, the mechanism comprising:

a first unit movable along a first direction to be drawn in and out of the image recording apparatus;

a second unit mounted in the first unit, the second unit being movable, with the first unit drawn out of the image recording apparatus, along a second direction that is substantially perpendicular to the first direction, to be drawn in and out of the first unit;

a plurality of supports including first and second supports, respectively arranged at first and second positions different from each other along the second direction, for supporting the first unit movably along the first direction; and a load-applying member mounted in the first unit to apply a gravitational load in such a manner that a center of gravity of the first unit along the second direction is located between the first and second positions along the second direction whether the second unit is retracted in, or drawn out of, the first unit.

2. The unit drawing mechanism according to claim 1, wherein the first and second supports are positioned at two different height levels.

3. The unit drawing mechanism according to claim 1, wherein the load-applying member is located on a side of the first unit where the second unit is drawn out, and wherein the first support is located on the side of the first unit where the second unit is drawn out has a higher strength than the second support.

4. The unit drawing mechanism according to claim 1, wherein each support includes a precision ball bearing slide rail assembly.

5. An image recording apparatus provided with a sheet transport path on which a sheet is transported from a sheet feeding section to a sheet output section through an electrophotographic image recording section, the sheet transport path including a first path and a second path, the apparatus comprising:

a first unit movable along a first direction to be drawn in and out of the apparatus, the first path being positioned in the first unit;

a second unit mounted in the first unit, the second unit being movable, with the first unit drawn out of the apparatus, along a second direction that is substantially perpendicular to the first direction, to be drawn in and out of the first unit, the second path being positioned in the second unit;

a plurality of supports including first and second supports, respectively arranged at first and second positions different from each other along the second direction, for supporting the first unit movably along the first direction; and a load-applying member mounted in the first unit to apply a gravitational load in such a manner that a center of gravity of the first unit along the second direction is located between the first and second positions along the second direction whether the second unit is retracted in, or drawn out of, the first unit.

6. The image recording apparatus according to claim 5, wherein the load-applying member is a fusing device for fixing a developer image on the sheet.

7. The unit drawing mechanism according to claim 1, wherein the first unit is heavier than the second unit.

8. The unit drawing mechanism according to claim 1, wherein when the first and second units are installed in the image forming apparatus, the second unit can be drawn out only when the first unit is drawn out of the image forming apparatus.

9. The unit drawing mechanism according to claim 1, wherein the second unit includes an upper movable plate and a side movable plate both being pivotable between open and closed positions when the second unit is drawn out of the first unit to expose at least portions of one or more sheet paths when one or both upper and side movable plates are opened.

10. The unit drawing mechanism according to claim 3, wherein the first support is positioned at a higher level than the second support.

11. The unit drawing mechanism according to claim 3, wherein the center of gravity is located closer to the first support than the second support along the second direction.

12. The image recording apparatus according to claim 5, wherein the first unit is heavier than the second unit.

13. The image recording apparatus according to claim 5, wherein the second unit can be drawn out only when the first unit is drawn out of the apparatus.

14. image recording apparatus according to claim 5, wherein the second unit includes an upper movable plate and a side movable plate both being pivotable between open and closed positions when the second unit is drawn out of the first unit to expose at least a portion of the second path when one or both upper and side movable plates are opened.

15. The image recording apparatus according to claim 5, wherein the load-applying member is located on a side of the first unit where the second unit is drawn out, wherein the first support is located on the side of the first unit where the second unit is drawn out has a higher strength than the second support, and wherein the first support is positioned at a higher level than the second support.

16. The image recording apparatus according to claim 5, wherein the load-applying member is located on a side of the first unit where the second unit is drawn out, wherein the first support is located on the side of the first unit where the second unit is drawn out has a higher strength than the second support, and wherein the center of gravity is located closer to the first support than the second support along the second direction.

* * * * *